United States Patent [19]

Kugisawa

[11] 4,030,395

[45] June 21, 1977

[54] MUSICAL-TONE SIGNAL FORMING APPARATUS FOR AN ELECTRONIC MUSICAL INSTRUMENT

[75] Inventor: Toshio Kugisawa, Hamamatsu, Japan

[73] Assignee: Kabushiki Kaisha Kawai Gakki Seisakusho, Hamamatsu, Japan

[22] Filed: June 5, 1975

[21] Appl. No.: 584,367

[30] Foreign Application Priority Data

June 6, 1974 Japan ..... 49-64382

[52] U.S. Cl. ..... 84/1.03; 84/1.24

[51] Int. Cl.[2] ..... G10H 5/02

[58] Field of Search ..... 84/1.01, 1.03, 1.11, 84/1.19, 1.28

[56] References Cited

UNITED STATES PATENTS

| | | | |
|---|---|---|---|
| 3,515,792 | 6/1970 | Deutsch | 84/1.28 |
| 3,743,755 | 7/1973 | Watson | 84/1.03 |
| 3,763,364 | 10/1973 | Deutsch | 84/1.03 |
| 3,809,786 | 5/1974 | Deutsch | 84/1.03 |
| 3,844,379 | 10/1974 | Tomisawa et al. | 84/1.03 |
| 3,854,365 | 12/1974 | Tomisawa | 84/1.03 |

*Primary Examiner*—Robert K. Schaefer
*Assistant Examiner*—Vit W. Miska

[57] ABSTRACT

A musical-tone signal forming apparatus for an electronic musical instrument is characterized by the use of a musical-tone waveform setting circuit by which repeatedly at least one cycle of a musical-tone waveform is sampled at *n* points so the amplitude thereof at each sampling point can be compared with the amplitude thereof at the preceding sampling point and an increase signal, an equal signal, or a decrease signal is generated as a digital signal. Also employed is an envelope setting circuit in which an envelope of a musical tone is sampled at *m* points and the analog amount thereof at each sampling point is generated as a corresponding digital signal. An integrating circuit is used in which the digital signals of the envelope setting circuit are accumulatively added or subtracted according to the digital signals of the musical-tone waveform setting circuit. The output signal of the integrating circuit is taken out through a D-A converter as a musical-tone signal. The integrating circuit comprises full adders connected in tandem and latch circuits provided on the output side thereof. AND circuits and exclusive OR circuits are interposed between the musical-tone waveform setting circuit and the envelope setting circuit and the full adders. The musical-tone waveform setting circuit is provided at its input side with a clock pulse generator, which generates a clock pulse signal corresponding to the frequency of a musical-scale tone by use of an order pulse generator and a counter. Each of the latch circuits is operated at the descending portion of each pulse generated by the clock pulse generator.

8 Claims, 10 Drawing Figures

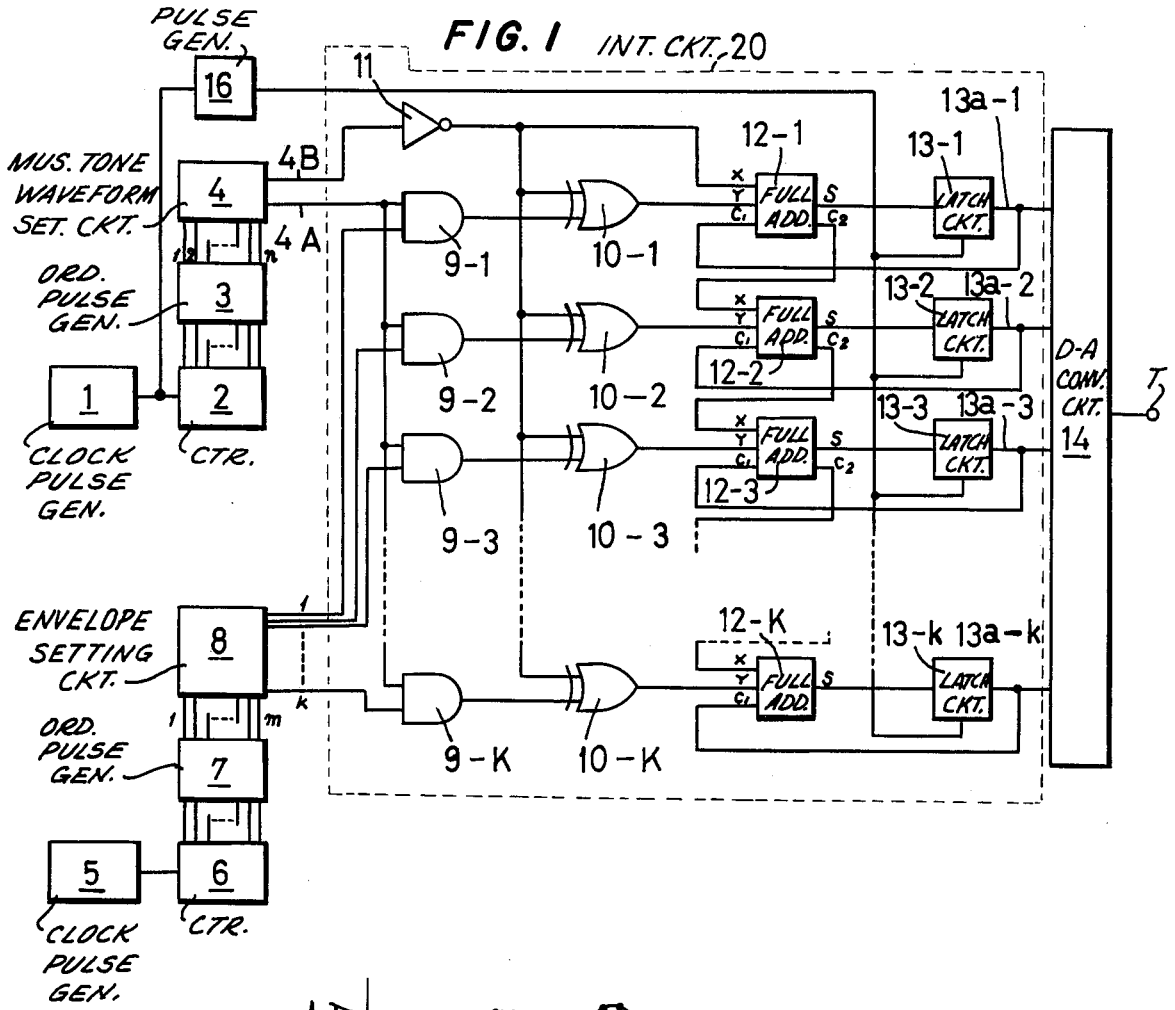
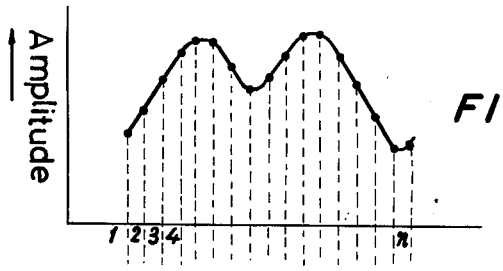
FIG. 2(C)
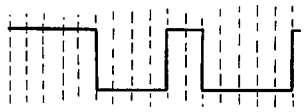
FIG. 2(A)
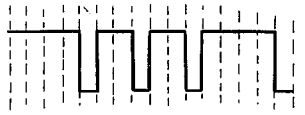
FIG. 2(B)
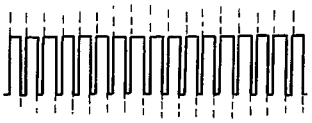
FIG. 2(D)
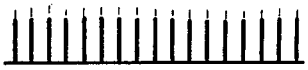
FIG. 2(E)

FIG. 3
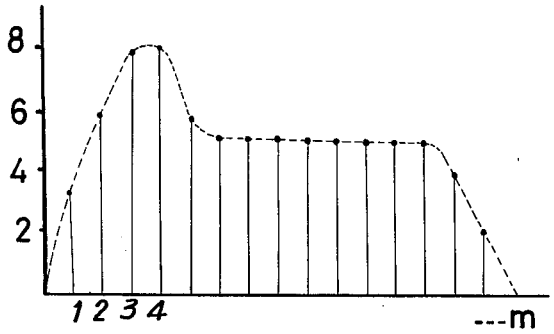
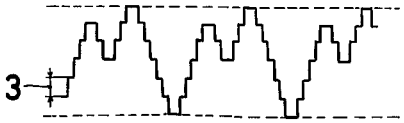
FIG. 4 (A)
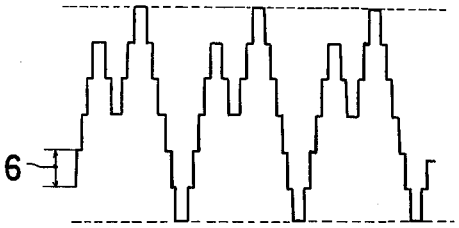
FIG. 4 (B)
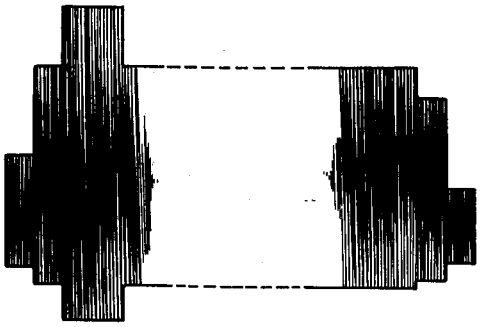
FIG. 5

MUSICAL-TONE SIGNAL FORMING APPARATUS FOR AN ELECTRONIC MUSICAL INSTRUMENT

FIELD OF THE INVENTION

This invention relates to circuits for forming a musical-tone signal in an electronic musical instrument.

BACKGROUND

In known circuits for forming a musical-tone signal in an electronic musical instrument, a musical-tone signal waveform is formed and is passed through an envelope circuit for forming a musical-tone signal having a particular envelope.

In this known type of circuit, the envelope circuit requires a large-capacity condenser and, therefore, the circuit is of an undesirable large size. Usually, therefore, the available envelope is limited to a particular range because of the necessity of limiting the capacity, so that it is impossible to form envelopes for various kinds of natural musical instruments as well as other envelopes of original design.

SUMMARY OF INVENTION

The present invention has an object the provision of an apparatus free from the above-noted defects.

The apparatus of the invention is characterized in that a musical-tone waveform setting means is used in which repeatedly at least one cycle of a musical-tone waveform is sampled at *n* points and the amplitude thereof at each sampling point is compared with the amplitude thereof at a preceding sampling point and an increase signal, an equal signal or a decrease signal is generated as a digital signal, there being furthermore employed an envelope setting means whereby it is effected that the envelope of a musical tone is sampled at *m* points and the analog amount thereof at each sampling point is generated as a corresponding digital signal. Also employed is an integrating means whereby the digital signals of the envelope setting means are accumatively added or subtracted according to the digital signals of the musical-tone waveform setting means. The output signal of the integrating means is taken out through a D-A converter as a musical tone signal.

BRIEF DESCRIPTION OF DRAWING

One embodiment of the invention will next be described with reference to the accompanying drawings in which:

FIG. 1 is a block diagram showing one example of this invention apparatus;

FIG. 2(C) is a diagram showing a musical-tone waveform;

FIGS. 2 (A), (B), (D), and (E) are diagrams showing output waveforms at respective portions;

FIG. 3 is a diagram showing sampling of an envelope;

FIGS. 4 (A) and (B) are diagrams showing enlarged portions of a musical tone signal; and FIG. 5 is a diagram showing a musical tone signal obtained by the apparatus of this invention.

DETAILED DESCRIPTION

In FIG. 1, a clock pulse oscillator or generator 1 is provided which generates a clock pulse signal of a frequency corresponding to a frequency of a musical-scale tone. The output terminal of generator 1 is connected through a first counter 2 and an order pulse generator 3 to a musical-tone waveform setting circuit 4.

The musical-tone waveform setting circuit 4 comprises a matrix circuit having *n* input terminals connected to output terminals 1-*n* of the order pulse generator 3, two output terminals 4A and 4B and *n* sampling portions. Each of the sampling portions comprises two setting points. At each sampling point of a musical-tone waveform (FIG. 2(C)), which it is desired be finally obtained, the amplitude thereof is compared with the amplitude thereof at the preceding sampling point. INCREASE is obtained when the amplitude is larger than the preceding amplitude, EQUAL is obtained when the amplitudes are equal or DECREASE is obtained when the later amplitude is smaller. There is obtained at the output terminals 4A and 4B a signal according to the following table:

| | Terminal: | |
|---|---|---|
| | 4B | 4A |
| INCREASE | 1 | 1 |
| DECREASE | 0 | 1 |
| EQUAL | 0 | 0 |
| | (1) | |

If, thus, the setting points at each sampling point are set according to a desired waveform as shown, for instance, in FIG. 2(C), there are obtained, at the output terminals 4A and 4B, output signals as shown in FIGS. 2(A) and 2(B), respectively by the order pulses applied, in order, to each input terminal of the musical-tone waveform setting circuit 4.

Circuit 5 is a clock pulse oscillator or generator for envelope forming. An output terminal thereof is connected through a second counter 6 and an order pulse generator 7 to an envelope setting circuit 8. The envelope setting circuit 8 comprises a matrix circuit having *m* output terminals connected to output terminals 1-*m* of the order pulse generator 7, *k* output terminals and *m* sampling portions. Each sampling portion thereof comprises *k* setting points arranged so that an analog amount at each sampling point of an envelope (FIG. 3) which it is desired be finally obtained, is converted into a digital signal of the binary scale of *k* bits. Thus, by a setting of each sampling portion as above, there can be obtained in order, at the *k* output terminals, digital signals of the binary scale of *k* bits by the order pulses applied, in order, to each input terminal of the envelope setting circuit 8. As for a known technique similar to the above, reference is made by way of example to U.S. Pat. No. 3,515,792.

Component 20 is an integrating circuit whereby the output signal signals of the envelope setting circuit 8 are accumatively added or subtracted in accordance with the output digital signals of the musical-tone waveform setting circuit 4. A specific construction for circuit 20 is described below.

In circuit 20, the *k* output terminals of the envelope setting circuit 8 are connected, respectively, to first input terminals of AND circuits 9-1, 9-2 . . . 9-*k* and the output terminal 4A of the musical-tone waveform setting circuit 4 is connected to second input terminals of the same. Output terminals of the AND circuits 9-1, 9-2 . . . 9-*k* are, respectively, connected to first input terminals of exclusive OR circuits 10-1, 10-2 . . . 10-*k* and the output terminal 4B of the musical-tone waveform setting circuit 4 is connected to second input terminals thereof through an inverter 11. Output terminals of the exclusive OR circuits 10-1, 10-2 . . . **10-*k* are connected to input terminals Y of respective full adder circuits 12-1, 12-2 . . . 12-*k* and S output terminals thereof are connected to a D-A converter circuit 14 through respective latch circuits 13-1, 13-2 . . . 13-*k***.

An X input terminal of the first full adder circuit 12-1 is connected to the output terminal of the inverter 11, and C2 output terminals of these circuits 12-1, 12-2 . . . **12-(*k*-1) are in order connected to the X input terminals of the next succeeding stages. Output terminals 13*a*-1, 13*a*-2 . . . 13a-*k* of the latch circuits 13-1, 13-2 . . . 13-*k* are connected to corresponding C1 input terminals of the full adder circuits 12-1, 12-2 . . . 12-*k*. Additionally, control terminals of the latch circuits 13-1, 13-2 . . . 13-*k* are connected through a single common line to an output terminal of the clock pulse oscillator 1 through a pulse generating circuit 16** including a differential circuit and serving to generate individual sharp pulses at descending portions of the clock pulses.

The operation of this invention apparatus will next be explained.

For the sake of convenience, explanation will be referred to a case in which each sampling portion of the envelope setting circuit 8 has six setting points and six output terminals (that is, six bits). Assuming an envelope as shown in FIG. 3, since the analog amounts thereof at the first, second . . . sampling points are 3, 6, 8, 8, 6 . . . , the setting points in each sampling portion are set as shown on the following table.

| Analog amount | Setting point No. | | | | | |
|---|---|---|---|---|---|---|
| | 6 | 5 | 4 | 3 | 2 | 1 |
| 3 | 0 | 0 | 0 | 0 | 1 | 1 |
| 6 | 0 | 0 | 0 | 1 | 1 | 0 |
| 8 | 0 | 0 | 1 | 0 | 0 | 0 |
| 8 | 0 | 0 | 1 | 0 | 0 | 0 |
| 6 | 0 | 0 | 0 | 1 | 1 | 0 |
| . | . | . | . | . | . | . |
| . | . | . | . | . | . | . |

At the musical-tone waveform setting circuit 4, sampling according to a waveform as shown in FIG. 2(C) is effected by way of INCREASE, DECREASE or EQUAL as mentioned above. Next, by the depressing of a key, output pulse signals of the clock pulse oscillators 1 and 5 are applied thereto as input signals. By the first order pulse generated from the order pulse generator 7, a digital signal (0, 0, 0, 0, 1, 1) corresponding to the amplitude analog amount of three is taken out from the output terminals 8-1, 8-2 . . . 8-6 of the envelope setting device 8 and the same is applied to the first input terminals of the AND circuits 9-1, 9-2 . . . 9-6.

In the meantime, by the first order pulse of the order pulse generator 3, an INCREASE signal (1, 1) is taken out from the output terminals 4A and 4B of the musical-tone waveform setting circuit 4. Thus, the output terminals of the AND circuits 9-1, 9-2 . . . 9-6 become (0, 0, 0, 0, 1, 1). This result is applied to the first input terminals of the exclusive OR circuits 10-1, 10-2 . . . 10-6. Additionally, the output 1 of the output terminal 4B is applied to the second input terminals of circuits 10-1, 10-2 . . . 10-6 being inverted into a 0 by the converter 11. Thus, the output terminals of the exclusive OR circuits 10-1, 10-2 . . . 10-6 become (0, 0, 0, 0, 1, 1) and these signals are applied to the Y input terminals of the full adder circuits 12-1, 12-2 . . . 12-6. Each of the C1 input terminals has a 0 applied thereto because the output terminals **13*a*-1, 13*a*-2 . . . 13*a*-6 of the latch circuits 13-1, 13-2 . . . 13-6 are 0. Further, the X input terminal of the first full adder circuit 12-1 has applied thereto the output 0 of the inverter 11**.

In addition, the full adder circuits 12-1, 1 . . . 12-6 are each so designed that the relation between the input and the output is as shown in the following table:

| INPUT | | | OUTPUT | |
|---|---|---|---|---|
| X | Y | $C_1$ | S | $C_2$ |
| 0 | 0 | 0 | 0 | 0 |
| 1 | 0 | 0 | 1 | 0 |
| 0 | 1 | 0 | 1 | 0 |
| 0 | 0 | 1 | 1 | 0 |
| 1 | 1 | 0 | 0 | 1 |
| 1 | 0 | 1 | 0 | 1 |
| 0 | 1 | 1 | 0 | 1 |
| 1 | 1 | 1 | 1 | 1 |

Thus, the output at the S output terminals of the full adder circuits 12-1, 12-2 . . . 12-6 becomes (0, 0, 0, 0, 1, 1).

Next, a sharp pulse (FIG. 2 (E)) generated by the pulse generator 16 corresponding to the descending portion of the first clock pulse (FIG. 2(D)) generated by the clock pulse oscillator 1 is applied as an input to each of the latch circuits 13-1, 13-2 . . . 13-6, so that the output signal at the S output terminals (0, 0, 0, 0, 1, 1) is memorized thereby. The output signal, at the same time, is taken from the respective output terminals **13*a*-1, 13*a*-2 . . . 13*a*-6 and converted by the D-A converter 14 into an analog signal and an analog amount of three is presented at terminal T. The output signal (0, 0, 0, 0, 1, 1) at the output terminals 13*a*-1, 13*a*-2 . . . 13*a*-6 is fed back to the $C_1$ input terminals of the full adder circuits 12-1, 12-2 . . . 12-6. The second order pulse produced by the second clock pulse of the clock pulse oscillator 1 is applied as an input to the musical-tone waveform setting circuit 4, and an INCREASE signal (1, 1) is obtained at the output terminals 4A and 4B thereof. This signal is similar to that obtained in the case of the first order pulse but is different therefrom in that the full adder circuits 12-1, 12-2 . . . 12-6 have the feedback signal applied at their $C_1$ input terminals. Thus, according to the foregoing table, the output signal at the S output terminals of the full adder circuits 12-1, 12-2 . . . 12-6 becomes (0, 0, 0, 1, 1, 0). If, next, the pulse obtained in correspondence to the descending portion of the second clock pulse is applied to each of the latch circuits 13-1, 13-2 . . . 13-6, the previously memorized signal is gone and the new output signal is memorized, whereby there is obtained at the output terminals 13*a*-1, 13*a*-2 . . . 13*a*-6 the output signal (0, 0, 0, 1, 1, 0). This corresponds to an analog signal of six and there can be obtained at the terminal T the analog amount of six through the D-A converter 14.**

Next, and similarly, when the third and fourth clock pulses are applied from the clock pulse generator 1, the outputs of the latch circuits 13-1, 13-2 . . . 13-6 become (0, 0, 1, 0, 0, 1) and (0, 0, 1, 1, 0, 0), respectively, and there is obtained at the terminal T the analog amounts of nine and twelve.

If, then, an EQUAL output signal (0, 0) is generated by the fifth clock pulse, the output signal of the AND circuits 9-1, 9-2 . . . 9-6 becomes (0, 0, 0, 0, 0, 0) and the output signal of the exclusive OR circuits 10-1, 10-2 . . . 10-6 becomes (1, 1, 1, 1, 1, 1). There is obtained, at the S output terminals of the full adder circuits, the output signal (0, 0, 1, 1, 0, 0) which corresponds to the analog amount of twelve.

Then, an output signal (0, 1) representing DECREASE is generated by the sixth clock pulse, and the output signal of the AND circuits 9-1 . . . 9-6 becomes (0, 0, 0, 0, 1, 1) and the output signal of the exclusive OR circuits 10-1 . . . 10-6 becomes (1, 1, 1, 1, 0, 0). The output signal at the S output terminals of the full adder circuits 12-1 . . . 12-6 becomes (0, 0, 1, 0, 0, 1) and the analog amount of nine is presented through the subtraction of the amount of three.

Thus, it is repeated that the digital signal corresponding to the first sampling in the envelope setting device 8 is accumulatively added or subtracted in order according to the digital signals of the musical-tone waveform setting circuit 4, whereby there is obtained a musical-tone signal of amplitude as shown in FIG. 4(A).

If a sampling signal of 6, that is, (0, 0, 0, 1, 1, 0) is applied as an input to the AND circuits 9-1, . . . 9-6, in almost the same manner as above, the output analog amounts of the D-A converter 14 become 6, 12, 18, 24, 24, 18 . . . , whereby there can be obtained a musical-tone signal of amplitude as shown in FIG. 4(B).

Subsequently thereto, accumulative adding or subtracting is effected throughout the whole range of the envelope in respect of the third, fourth . . . sampling signals of 8, 8, 6 . . . , and there can be finally obtained a musical-tone signal having an envelope as shown in FIG. 5.

Though a case is illustrated such that the sampling number for the musical-tone waveform and the envelope is comparatively small, it is a matter of detail that a resultant signal can be obtained which is closer to a predetermined musical-tone signal if the sampling number is increased. Thus, any desired envelope forming can be obtained if each sampling portion of the envelope setting device is properly designed. For instance, it becomes possible to form an envelope for vibrato by giving a vibration damping to the envelope.

In case the invention is applied to a keyed electronic musical instrument, a number of circuits corresponding to the number of keys must be provided. In this case, the clock pulse oscillator 5 for envelope forming can be used in common. It is obvious, however, that the oscillation frequency of the clock pulse oscillator 1 should be *n* times the frequency intended to be finally obtained.

Thus, according to this invention, a musical-tone waveform is subjected to sampling and increase, equal and decrease characteristics thereof are detected. By the digital signals obtained therefrom, the digital signals obtained from an envelope are accumulatively added or subtracted and thereby a musical-tone signal is obtained. Any desired musical-tone waveform and envelope can be imagined and a musical-tone signal accurately corresponding thereto can be obtained. The apparatus can be that of the IC type because it is operated only by digital signals.

What is claimed is:

1. Musical-tone signal forming apparatus for an electronic musical instrument comprising a musical-tone waveform setting means for the sampling of the amplitude of a musical-tone waveform at *n* points and for generating relative to each point an increase, decrease or equal digital signal indicating the relationship to the previous point, an envelope setting means for sampling the envelope of the musical tone at *m* points and generating a digital signal representative of the analog value of the envelope at each point, an integrating circuit means in which the digital signals of the envelope setting means are accumulatively added or subtracted under control of the digital signals of the musical-tone waveform setting means to form a digital output signal, and digital-to-analog converter means to convert said output signal into a musical-tone signal.

2. Musical-tone signal forming apparatus as claimed in claim 1 wherein said integrating circuit means comprises a sequence of parallel full adder circuit means coupled in tandem, and latch circuit means coupling respective of said full adder circuit means to said converter means and being coupled in feedback relation to the associated full adder circuit means, said latch circuit means memorizing outputs of the full adder circuit means, which generally add or subtract digital signals received from the next preceding full adder circuit means, from the associated latch circuit means and from waveform and envelope setting means.

3. Musical-tone signal forming apparatus as claimed in claim 2 comprising a sequence of AND circuits coupled in parallel to both said setting means and exclusive OR circuits coupling and AND circuits to said full adder circuit means.

4. Musical-tone signal forming apparatus as claimed in claim 3 comprising a clock pulse generator generating a clock pulse signal, a counter coupled to said generator, and an order pulse generator coupling said counter to said musical-tone waveform setting means whereby a signal is generated corresponding in frequency to a music-scale tone.

5. Musical-tone signal forming apparatus as claimed in claim 4 comprising a pulse generator means coupled to and operating from said clock pulse generator and operating said latch circuit means on the descending edges of the clock pulses.

6. Musical-tone signal forming apparatus as claimed in claim 5 comprising a clock pulse generator generating a clock pulse signal, a counter coupled to said generator, and an order pulse generator coupling said counter to said envelope setting means.

7. Musical-tone signal forming apparatus as claimed in claim 6 comprising an inverter coupling said musical-tone waveform setting means to said exclusive OR circuits.

8. Musical-tone signal forming apparatus as claimed in claim 7 wherein the envelope setting circuit includes *m* sampling outputs and there are *m* AND circuits respectively coupled thereto.

* * * * *